United States Patent [19]

Mendenhall

[11] Patent Number: 4,503,871

[45] Date of Patent: Mar. 12, 1985

[54] DISPOSABLE TOOTHBRUSH

[76] Inventor: Burke H. Mendenhall, 10768 Downing St., Carmel, Ind. 46032

[21] Appl. No.: 422,553

[22] Filed: Sep. 24, 1982

[51] Int. Cl.[3] ..... A46B 11/00

[52] U.S. Cl. ..... 132/84 B; 401/123; 401/268

[58] Field of Search ..... 132/84 R, 84 B, 84 D; 401/123, 132, 191, 268; 206/614, 538

[56] References Cited

U.S. PATENT DOCUMENTS

| | | | |
|---|---|---|---|
| 1,925,818 | 9/1933 | Primeau et al. | 401/123 |
| 2,790,449 | 4/1957 | Hennings | 401/268 |
| 3,325,000 | 6/1967 | Edwards | 206/614 X |
| 3,593,725 | 7/1971 | Ortega | 132/84 B |
| 4,140,140 | 2/1979 | Proia et al. | 132/84 B |

FOREIGN PATENT DOCUMENTS

| | | | |
|---|---|---|---|
| 576766 | 8/1974 | Switzerland | 132/84 R |

*Primary Examiner*—Steven A. Bratlie

*Attorney, Agent, or Firm*—Woodard, Weikart, Emhardt & Naughton

[57] ABSTRACT

A toothbrush is made of molded plastic and has a handle which is largely hollow with an open wall and transverse ribs providing structural rigidity and defining compartments. Pre-packaged dentifrice packages are received in the compartments and have peel-off covers secured to the packages and severable from each other and the container to permit individual removal of packages from the handle while, at the same time, preserving the integrity of the remaining packages and the sealing of the compartments in which the packages are received.

10 Claims, 4 Drawing Figures

DISPOSABLE TOOTHBRUSH

BACKGROUND OF THE INVENTION

1. Field Of The Invention

This invention relates generally to toothbrushes, and more particularly to a toothbrush having special convenience for travelers, in that it provides conveniently accessible unit packaging of dentifrice, and is inexpensive enough to be regarded as disposable.

2. Description Of The Prior Art

The prior art of which I am aware comprises ordinary toothbrushes, and units disclosed in United States patents discovered in a search as follows: U.S. Pat. Nos. 2,443,425, issued to Iverson on June 15, 1948; 3,593,725, issued to Ortega on July 20, 1971; 3,952,867, issued to McCord on Apr. 27, 1976; 3,991,776, issued to Duffy on Nov. 16, 1976; 4,198,171, issued to Lampka et al. on Apr. 15, 1980; and 4,275,750, issued to Clark on June 30, 1981. These patents disclose a variety of ways of storing dentifrice, and some of them show individual tubes, vials, or packages. The one most nearly related to my invention is the Ortega patent which shows, in FIGS. 5 and 6, three individual dentifrice containers 30 in the handle. The user must remove a plug or cap 31 from the end of the handle to get access to the dentifrice containers. The containers 30 are loose inside the handle so that when the cap is removed, they can slide out. Accordingly, when one or two of the containers have been removed, the remaining container or containers are free to slide within the handle.

It is desirable to provide a toothbrush which is producible at a minimal cost and wherein the dentifrice is readily accessible, although containerized. The present invention is addressed to this need.

SUMMARY OF THE INVENTION

Described briefly, according to a typical embodiment of the present invention, a toothbrush is provided with a handle having a plurality of compartments therein, all opening at a common margin of the handle. Each compartment receives a package of dentifrice therein. Each package is covered by a membrane which serves as a common covering for all of the compartments of the handle but is serrated or otherwise weakened at the walls intermediate the compartments so as to facilitate removing one package from the handle at a time, while the others remain securely in place.

DESCRIPTION OF THE PREFERRED EMBODIMENT

Figure 1:
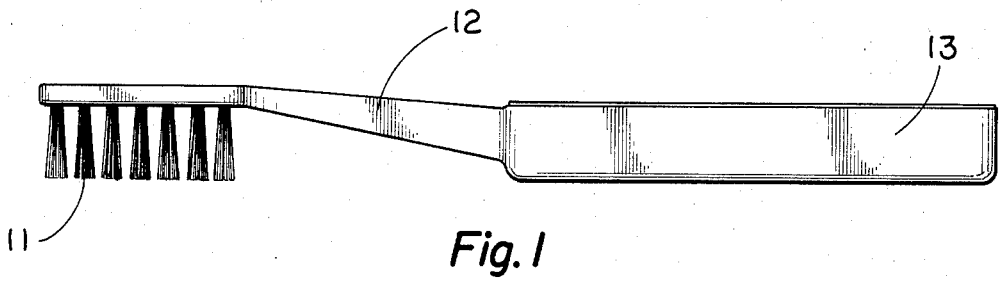
FIG. 1 is a side elevational view of a toothbrush assembly according to a typical embodiment of my invention.
Figure 2:
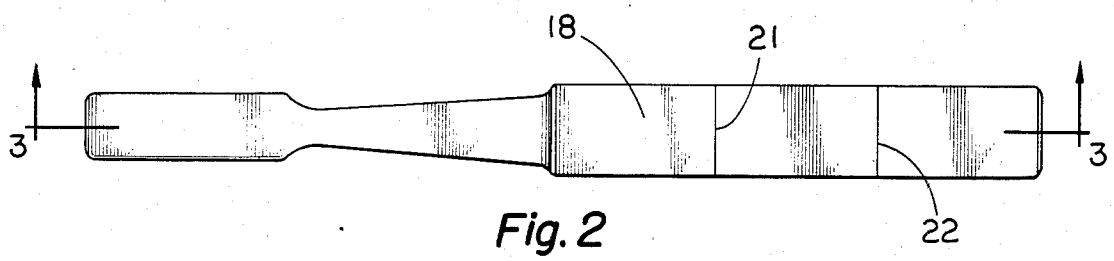
FIG. 2 is a top plan view thereof.
Figure 3:
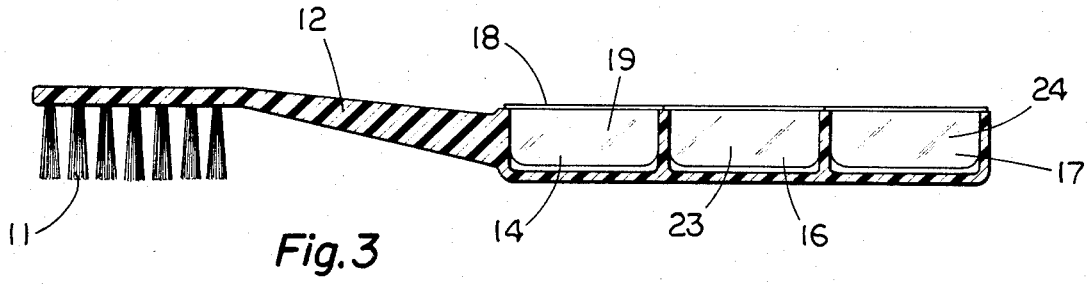
FIG. 3 is a section therethrough taken at line 3—3 in FIG. 2 and viewed in the direction of the arrows, but without sectioning the dentifrice packages.
Figure 4:
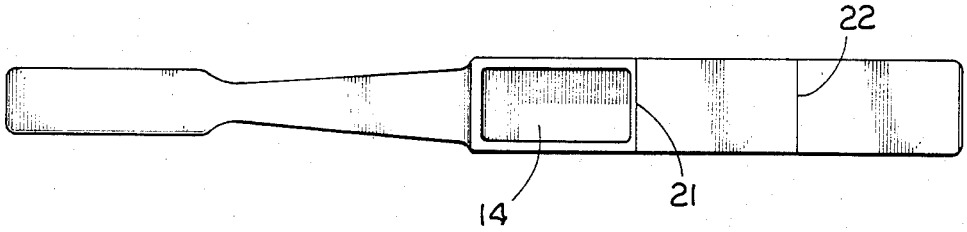
FIG. 4 is a top plan view of the toothbrush with one of the toothpaste cartridges removed therefrom.

Referring now to the drawings in detail, the toothbrush may be made entirely of plastic and includes bristles 11 secured in a head at one end of shank 12, with a handle at the other end of shank 12. The handle is formed with ribs defining three compartments 14, 16, and 17. These compartments are open topped and each of them receives an encapsulated quantity of toothpaste. This can be done by providing a package including a foil protected backing or substrate 18 with a "blister" 19 thereon, the blister containing the toothpaste. Such blister packaging of medicine capsules, such as for Contact, Dimacol, and others, is well known.

The substrate 18 has tear assisting perforations or scores along lines over the compartment wall ribs as at 21 and 22 so that the individual blisters 23 and 24 will not be removed from the handle, but will remain in their proper compartments until the user has used the paste in the blister 19. The amount in 19 would be sufficient for one or several brushings, depending upon the user's practice. Each of the blister packs is discarded, when exhausted. The toothpaste can be removed readily from a blister package by squeezing the package while holding the substrate. To assist in this, a punch-out or tear-out can be provided in the substrate at a corner, for example.

In order to be sure that the cartridges remain in place in the handle, until they are intentionally torn away for use, it is preferable that there be some adhesive attachment of the bottom of the substrate to the top of the handle around the margins of the compartments.

As apparent from the drawing, the amount of toothpaste in a single package is possibly two to three times as much as a user of the brush would ordinarily use at one brushing. A tenth of a fluid ounce could be adequate. In any event, the size of the package can be established at whatever is deemed most practical from the user's point of view. It may be desirable to provide enough in one package for three or four brushings per day. Then another package could be removed from the handle for the next day usage. It should also be noted that a cover for the brush head and shank can be provided if desired as in the above mentioned Ortega patent, for example.

While this description refers to "blister" packaging, other types might also be used. An example is container 30 with label 38 bonded to lip 40 in U.S. Pat. No. 3,512,858 issued May 19, 1970.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A toothbrush comprising a head portion having a brush thereon, a shank portion extending from said head portion, and a handle extending from said shank portion, said handle being generally hollow with cavity means having one substantially open elongate wall; and dentifrice package means in the cavity means of said handle and having cover means adhered to said handle and covering the package means and the cavity means to provide a closed cavity in the handle.

2. The toothbrush of claim 1 and further comprising:

a plurality of integral transverse ribs in the handle thereby compartmenting said cavity.

3. The toothbrush of claim 1 wherein:

said package means includes a plurality of dentifrice packages.

4. The toothbrush of claim 3 wherein:

said cover means is common to all of said packages and includes bridging portions between said packages which are severable to permit removal of packages individually from said handle separately from each other.

5. The toothbrush of claim 4 wherein:

said cover means is adhesively secured to said packages and said handle.

6. The toothbrush of claim 5 and further comprising:

a plurality of integral transverse ribs across said handle dividing the cavity into a plurality of compartments, said cover means being adhesively secured to the upper edges of said ribs.

7. The toothbrush of claim 6 wherein:

all of said compartments open at a common edge of said handle lying in a plane, said cover means being planar and secured to said handle in said plane.

8. The toothbrush of claim 7 wherein:

said handle, shank portion, and head portion are an integral unit of molded plastic.

9. The toothbrush of claim 6 and further comprising:

tear assisting means in said cover means along the upper edges of said ribs.

10. The toothbrush of claim 9 wherein:

said tear assisting means include score lines.

* * * * *